US005429551A

United States Patent [19]

Uecker et al.

[11] Patent Number: 5,429,551

[45] Date of Patent: Jul. 4, 1995

[54] INSPECTION PAN FOR COIN HANDLING MACHINE

[75] Inventors: Richard P. Uecker, Juneau; Robert J. Wagner, Milwaukee; Thomas P. Adams, Oconomowoc, all of Wis.

[73] Assignee: Brandt, Inc., Watertown, Wis.

[21] Appl. No.: 214,877

[22] Filed: Mar. 15, 1994

[51] Int. Cl.[6] ..... G07D 1/00

[52] U.S. Cl. ..... 453/18; 453/63

[58] Field of Search ..... 453/3-15, 453/17, 18, 31, 63; 194/344

[56] References Cited

U.S. PATENT DOCUMENTS 4,383,540 5/1983 DeMeyer et al. ..... 453/3
4,964,495 10/1990 Rasmussen ..... 194/344
5,295,899 3/1994 Adams et al. ..... 453/10

FOREIGN PATENT DOCUMENTS 1228085 11/1966 Germany ..... 453/63

OTHER PUBLICATIONS

Brandt Model 6500 Series High Speed Coin Sorter and Counter Maintenance Manual, 1993, Introduction and Sections Nos. 1, 5, 6, and 8.

*Primary Examiner*—F. J. Bartuska
*Attorney, Agent, or Firm*—Quarles & Brady

[57] ABSTRACT

A coin handling machine has an opening in the top of its housing that is normally closed by an inspection pan. The inspection pan is mounted to the housing so that it can be pivoted across the top to expose the opening and tipped to empty the contents of the pan out an exit at a corner of the pan and into the exposed opening.

10 Claims, 3 Drawing Sheets

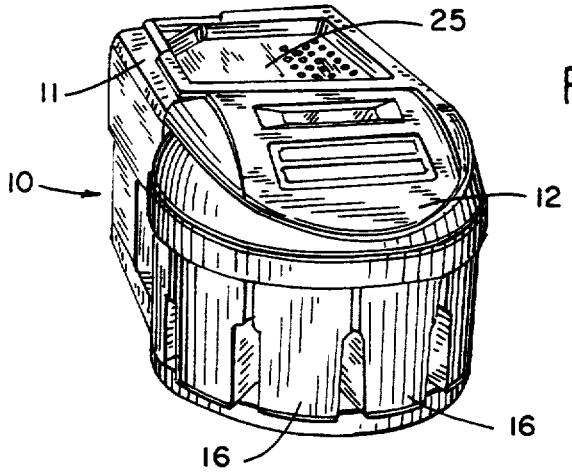
FIG. 1
FIG. 2
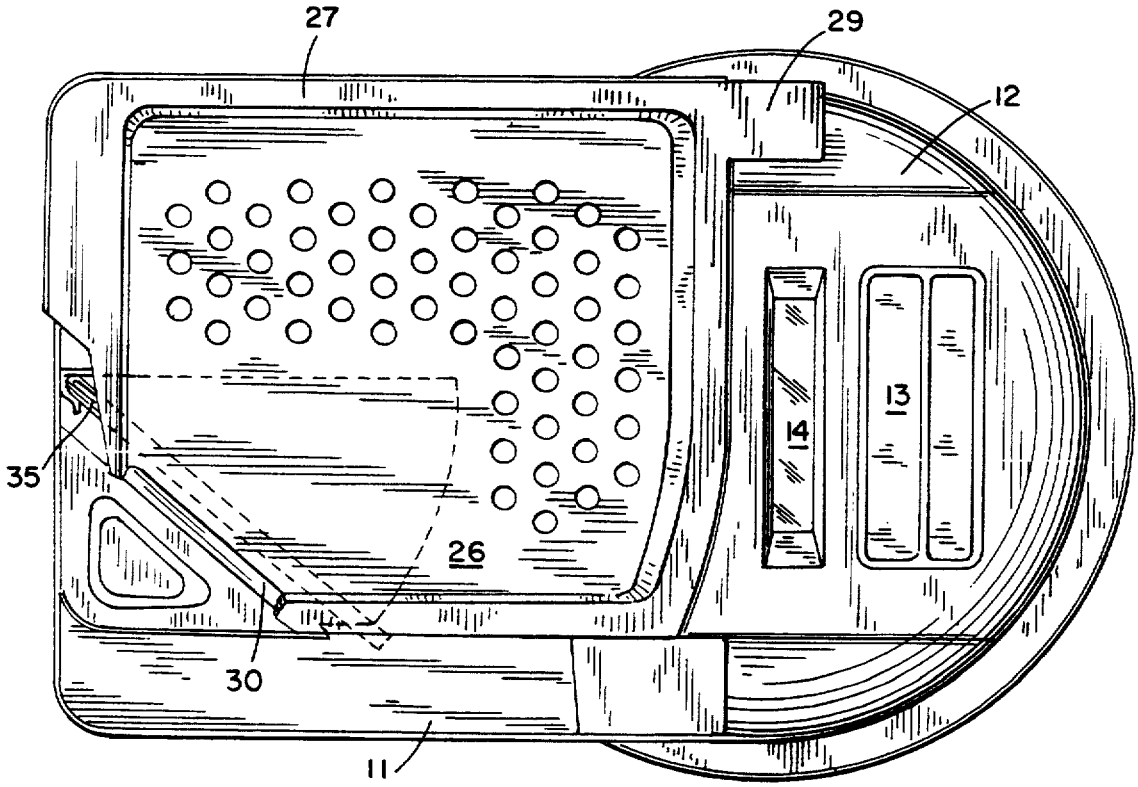

INSPECTION PAN FOR COIN HANDLING MACHINE

BACKGROUND OF THE INVENTION

This invention relates to coin handling machines, and particularly to an improved inspection pan assembly for such machines.

Coin handling machines include those that are used to count and package coins of a single denomination and those that sort a mixed batch of coins into their respective denominations. Coin handling machines typically include an opening into which coins are deposited for processing. It is common to use an inspection pan prior to depositing the coins into the opening. The inspection pan is usually mounted adjacent the opening. A batch of coins to be processed is deposited in the pan so that an operator can visually remove unwanted items from the batch of coins, including slugs and debris. After visual inspection, the coins in the pan are emptied into the opening. Some inspection pans are mounted to tip to allow the contents of the pan to slide off the pan and through the opening for processing by the machine.

SUMMARY OF THE INVENTION

It is a principal object of the invention to provide an inspection pan assembly for a coin handling machine which includes an inspection pan that normally covers the opening through which coins are deposited into the machine for processing.

It is another object of the invention to provide an inspection pan assembly in which a simple one-hand operation allows the inspection pan to be moved to uncover the opening and tipped to empty its contents through the opening into the machine.

It is a further object of the invention to provide an inspection pan assembly in which the pan is readily removable from the coin handling machine.

It is also an object of the invention to provide an inspection pan assembly which prevents opening of a hinged cover leading to the operating mechanism of the machine when the inspection pan is in place.

In accordance with the invention, an inspection pan assembly is provided for a coin handling machine having a housing with a top that has an opening through which coins are introduced into the machine for processing. An inspection pan has a bottom for receiving a batch of coins and an upstanding rim extending around the bottom except at an exit. The bottom of the inspection pan is adapted to overlie the top of the housing and close off the opening. A connector joins the pan to the housing. The connector permits the inspection pan to be rotated across the top of the housing to expose the opening and permits the pan to be tipped to empty the contents of the pan through the exit and into the opening after the opening has been exposed.

Also in accordance with the invention, the housing has a wall rising from the top at an edge of the opening. The exit of the pan abuts against the wall when the pan is in place over the opening to close the exit. In the preferred embodiment, the rim of the pan abuts the wall and prevents tipping of the pan until the pan has been rotated to expose the opening.

In the preferred embodiment, the connector includes a rod that is pivotably held at one end in the housing and whose opposite end describes an arc when the rod is pivoted to thereby sweep across the opening. The pan is mounted on the rod for rotation about the axis of the rod to allow the pan to be pivoted with the rod and tipped about the axis. The one end of the rod is preferably removably received in the housing in a recess with the other end of the rod captured beneath the housing such that the pan may be removed from the housing by removing the rod from engagement with the housing.

The pan may have a generally rectangular bottom with the exit formed at a truncated corner of the rectangle. The opening in the housing may be pie-shaped. The bottom of the pan may have perforations in the area which does not directly overlie the opening so that dust and debris may pass through the perforations to the top of the housing below, and the housing top may be dished to provide a receptacle for the dirt and debris.

Also in accordance with the invention, the housing includes a hinged cover, the upper portion of which forms a part of the top surface of the housing. The inspection pan overlies the hinged cover when the pan is in place over the opening to prevent the opening of the cover.

The foregoing and other objects and advantages of the invention will appear in the following detailed description in which reference is made to the accompanying drawings that illustrate a preferred embodiment of the invention.

BRIEF DESCRIPTION OF THE DRAWINGS

FIG. 1 is a view in perspective of a coin sorter incorporating the inspection pan assembly of the present invention;

FIG. 2 is a top plan view of the sorter of FIG. 1;

DETAILED DESCRIPTION OF THE PREFERRED EMBODIMENT

Figure 3:
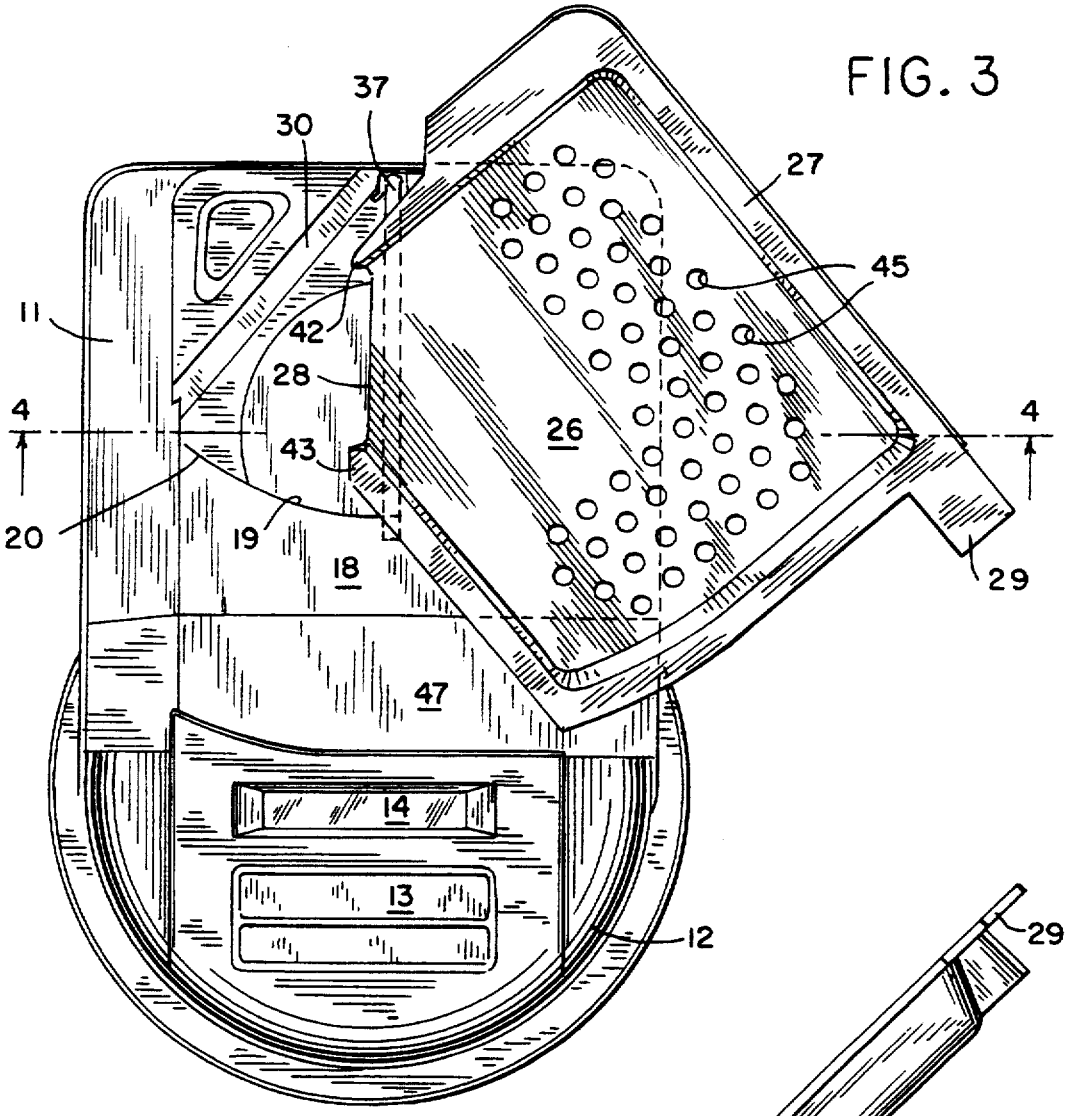
FIG. 3 is a view similar to FIG. 2 but showing the inspection pan rotated to expose the opening to the machine.

The inspection pan assembly is illustrated as being used in conjunction with a coin sorter having a housing 10 with a top 11 and with a front cover 12 that is hinged to the top 11. The front cover 12 mounts a control pad 13 and a display 14. The front cover 12 provides access to the coin sorter mechanism 15 located within the housing.

The sorter 10 may use the coin alignment and sorting mechanisms that are illustrated and described in copending application Ser. No. 07/845,122 filed Mar. 3, 1992, for "Two Disc Coin Handling Apparatus" that will issue on Mar. 22, 1994, as U.S. Pat. No. 5,295,899, the disclosure of which is incorporated by reference as if fully set forth herein. In such coin sorter, coins are deposited on the surface of a rotating disc which forms the coins into a single file and single layer and feeds the aligned coins to a sorting plate in which the coins exit at spaced openings in the plate depending upon their size. Each denomination of coin to be sorted will fall into a respective drawer 16 that collects that denomination.

The structure and arrangement of the drawers 16 are fully described in application Ser. No. 08/213,322 of Thomas P. Adams, Joseph P. Hanus, Kenneth G. Ebenhoch, and Roger Klemp for "Collector Assembly for Coin Handling Machine" filed on the same date as this application, and whose disclosure is incorporated by reference as if set forth herein.

The top 11 of the housing 10 has a horizontal surface 18 with a pie-shaped opening 19 that leads to the rotating disc 20 on which coins are deposited for alignment and feeding to the sorting mechanism 15. The pie-shaped opening 19 is to one side of the center of the rotating disc 20.

An inspection pan 25 has a flat bottom 26 and an upstanding rim 27 that extends around the periphery of the bottom 26 except for a gap that defines an exit 28 for the pan 25. The bottom 26 is generally rectangular and the exit 28 is defined by truncating a corner of the normal rectangular shape of the bottom 26. A handle portion 29 extends from a corner of the pan 25 opposite the exit 28. The inspection pan 25 may rest upon the surface 18 of the top 11 with a portion of the bottom 26 of the pan 25 closing the opening 19, as seen in FIG. 2. The top 11 of the housing 10 includes an upright wall portion 30 at one edge of the opening 19. When the inspection pan 25 is in place upon the top 11 in a position to close the opening 19, the wall 30 of the housing forms an extension of the rim 27 of the pan 25 and closes the exit 28.

Figure 6:
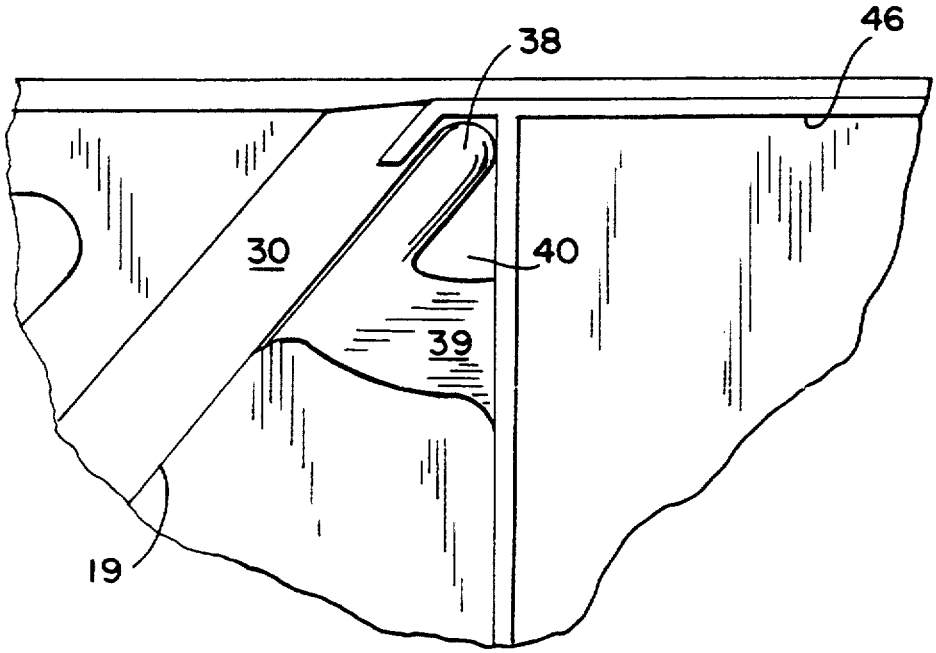
FIG. 6 is an enlarged partial plan view showing the detail of the mounting for one end of the rod in the housing.

A rod 35 is mounted in a bracket 36 extending beneath the bottom 26 of the pan 25 adjacent the exit 28. The rod 35 extends generally parallel with the edge that defines the exit 28. One end 37 of the rod 35 is mounted in a corner recess 38 in the top 11 at the apex of the opening 19. As shown in FIG. 6, the recess 38 is defined by a lower shelf 39 which extends across the apex of the opening 19 and a ledge 40 spaced above the shelf 39. The ledge 40 is sized to form an opening for the rod 35 that is adjacent to and parallel to the wall 30 to permit the rod 35 to be inserted vertically past the ledge 40 and against the shelf 39. The other end of the rod is received beneath an edge of the opening 19 in the top 11.

As will be appreciated from the drawings, the connector formed by the rod and the housing allows the rod to pivot about its one end 37 to pivot or rotate the pan 25 from a position covering the opening 19 to a position in which the opening 19 is exposed. The pan 25 can also be tipped about the longitudinal axis of the rod 35 to allow the contents of the pan to be dumped through the exit 29 through the opening 19 and onto the surface of the rotating disc 20 beneath the opening 19.

When the pan 25 is in place on the top 11 of the housing 10 and closing the opening 19, the ends 42 and 43 of the pan rim 27 at the exit 28 abut the wall 30 in the housing 10. As a result, it is not possible to tip the pan 25 because of the interference between the ends 42 and 43 of the rim 27 and the wall 30. The pan 25 can be tipped only after it has been rotated to expose the opening 19. This prevents accidental tipping of the pan 25 and dumping of its contents over the top 11 of the housing 10 rather than through the opening 19.

The inspection pan 25 is easily removed from the housing 10. When the pan 25 is at rest on the top 11 in a position closing the opening 19, the one end 37 of the rod 35 can be lifted out of the corner recess 38 and the opposite end of the rod 35 can be slipped out from beneath the edge of the opening 19, thereby freeing the pan 25. The pan 25 cannot be removed from the housing 10 once the pan has been rotated to expose the opening 19 because the rod 35 is trapped beneath the ledge 40.

Figure 4:
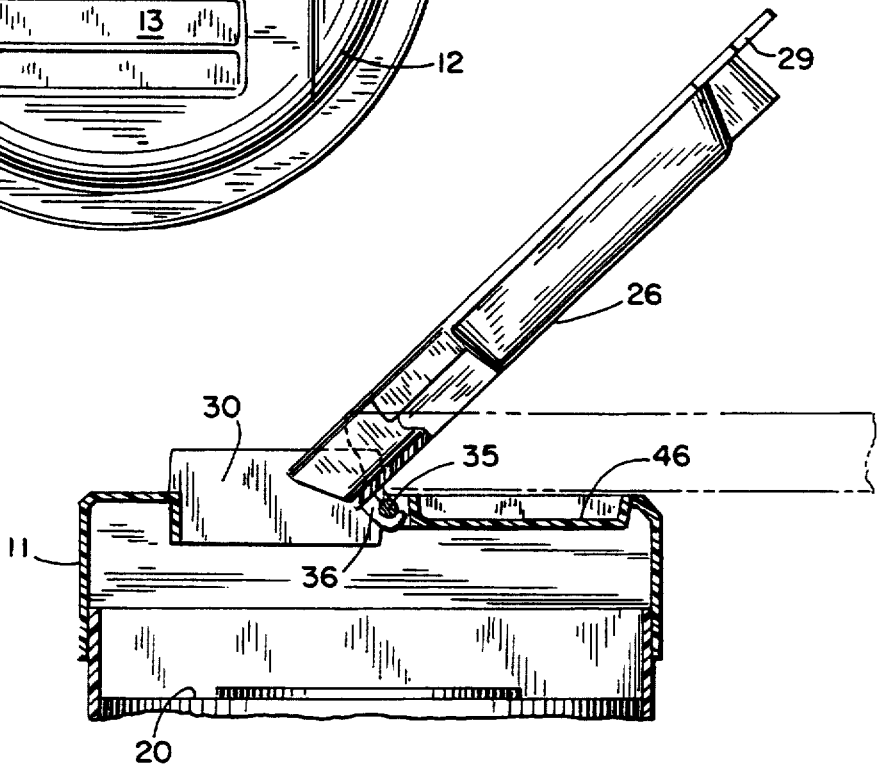
FIG. 4 is a view taken in the plane of the line 4—4 of FIG. 3 showing the inspection pan tipped as it would be to empty its contents through the opening and into the machine.

As shown in the drawings, the bottom 26 of the inspection pan 25 may be provided with a series of perforations 45 through which dust and debris can fall while the contents of the inspection pan 25 are being inspected. Preferably, these perforations 45 do not extend to the area of the bottom 26 which closes off the opening 19. Debris falling through the perforations 45 will collect on the upper surface 18 of the top 11 of the housing 10 and a portion 46 of the upper surface may be dished as shown in FIG. 4 to accumulate such debris.

Figure 5:
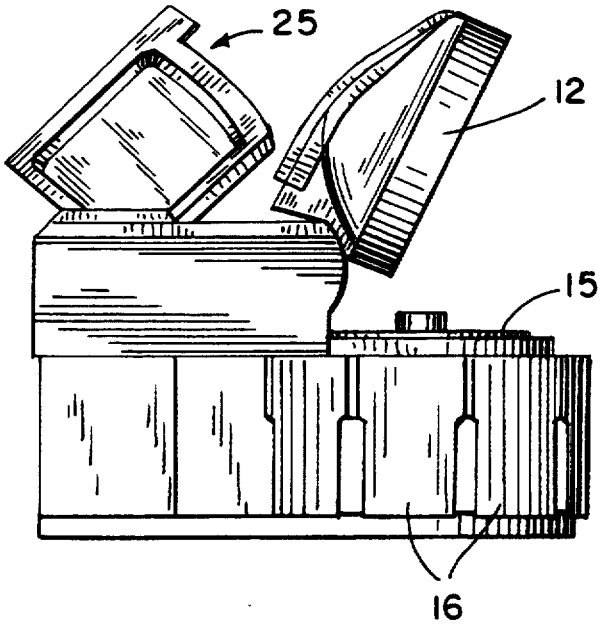
FIG. 5 is a side view of the sorter showing the hinged front cover raised to expose the sorting mechanism of the sorter.

The horizontal surface 18 of the top 11 is defined in part by a top surface 47 of the front cover 12. When the inspection pan 25 is in place on the housing 10 covering the opening 19, the pan 25 also rests upon that surface 47 of the front cover 12. As a result, the front cover 12 cannot be opened until the inspection pan 25 has been moved out of the way and held in the position shown in FIG. 5, or until the pan 25 has been removed from the housing 10. This requires a conscious act on the part of an operator to open the front cover 12 which typically includes interlocks that will immediately stop the operation of the machine when the cover 12 is opened.

The closing off of the opening 19 by the pan 25 provides automatic separation of batches of coins being processed by the machine and those awaiting processing. The batch of coins that is deposited in the pan 25 cannot accidentally enter the opening 19, and the integrity of the batch in the pan 25 is thereby maintained. The closing of the opening 19 by the pan also tends to dampen the sound of the coins being processed within the machine.

We claim:

1. In a coin handling machine having a housing with an opening in its top through which coins can be introduced for processing, the combination therewith of:

an inspection pan having a bottom for receiving coins and an upstanding rim extending around such bottom except at an exit; and a connector for joining the pan to the top of the housing with the bottom overlying the opening adjacent the exit, the connector mounting the inspection pan for rotation across the top of the housing to expose the opening and also mounting the pan so that it can be tipped to empty the contents of the pan through the exit and into the opening.

2. An inspection pan assembly for a coin handling machine, comprising:

a housing having a top with an opening through which coins are introduced into the machine for processing;

an inspection pan for holding a batch of coins and having a bottom and an upstanding rim extending around the bottom except at an exit, the bottom of the pan being adapted to rest upon the top of the housing to close off the opening; and a rod held at one end in the housing and pivotable about such one end to sweep across the opening, the pan being mounted on the rod for rotation about the axis of the rod whereby the pan may be pivoted with the rod across the top to expose the opening and tipped to empty the contents of the pan through the exit and into the opening.

3. An inspection pan assembly in accordance with claim 2 wherein the housing has a wall rising from the top at an edge of the opening and against which the exit of the pan abuts to close the exit when the pan is in place over the opening.

4. An inspection pan assembly in accordance with claim 3 wherein the rim of the pan abuts the wall of the housing and prevents tipping of the pan until the pan has been pivoted to expose the opening.

5. An inspection pan assembly in accordance with claim 2 wherein the bottom of the pan is generally rectangular and the exit is formed at a truncated corner of the bottom.

6. An inspection pan assembly in accordance with claim 2 wherein the opening is pie shaped.

7. An inspection pan assembly in accordance with claim 2 wherein the bottom of the pan is provided with perforations in areas of the bottom that do not overlie the opening, and the top of the housing is dished to catch material that falls through the perforations.

8. An inspection pan assembly in accordance with claim 2 wherein the housing includes a hinged cover having an upper portion forming a part of the top of the housing that is overlaid by the pan when the pan is resting on the top.

9. An inspection pan assembly in accordance with claim 2 wherein the rod is attached to the underside of the bottom, the housing has a corner recess with a shelf on and against which the one end of the rod rests, and the other end of the rod is captured in the top beneath an edge of the opening.

10. An inspection pan assembly in accordance with claim 9 wherein the housing has a ledge spaced above the shelf and which prevents removal of the one end of the rod when the rod is pivoted away from the position in which the pan closes the opening.

* * * * *